US008235100B2

(12) United States Patent
Uribe Quintanilla et al.

(10) Patent No.: US 8,235,100 B2
(45) Date of Patent: Aug. 7, 2012

(54) WATER COOLED PANEL

(75) Inventors: Antonio Uribe Quintanilla, Monterrey (MX); Jorge Carlos Gonzalez Cruz, San Pedro Garza Garcia (MX)

(73) Assignee: Melter, S.A. de C.V., Apodaca, Nuevo Leon (MX)

( * ) Notice: Subject to any disclaimer, the term of this patent is extended or adjusted under 35 U.S.C. 154(b) by 163 days.

(21) Appl. No.: 12/861,548

(22) Filed: Aug. 23, 2010

(65) Prior Publication Data

US 2010/0314091 A1 Dec. 16, 2010

Related U.S. Application Data

(60) Continuation-in-part of application No. 11/504,670, filed on Aug. 16, 2006, now abandoned, which is a division of application No. 10/769,907, filed on Feb. 3, 2004, now Pat. No. 7,629,025.

(30) Foreign Application Priority Data

Nov. 17, 2003 (MX) ..... NL/a/2003/000043

(51) Int. Cl.
*F28F 1/00* (2006.01)

(52) U.S. Cl. ..... 165/177; 165/172; 29/890.047

(58) Field of Classification Search ..... 165/170, 165/172, 177; 29/890.047
See application file for complete search history.

(56) References Cited

U.S. PATENT DOCUMENTS

| | | | | |
|---|---|---|---|---|
| 2,908,070 | A | 10/1959 | Thomas et al. | |
| 3,229,489 | A | 1/1966 | Huet | |
| 3,753,635 | A | 8/1973 | Barnett | |
| 4,438,808 | A | 3/1984 | Venables et al. | |
| 4,581,800 | A | 4/1986 | Johnson | |
| 4,583,583 | A | 4/1986 | Wittel | |
| 4,778,004 | A * | 10/1988 | Paulman et al. | 165/150 |
| 5,222,552 | A | 6/1993 | Schuchert | |
| 5,228,198 | A | 7/1993 | Paulman et al. | |
| 5,491,996 | A | 2/1996 | Baarman et al. | |
| 5,669,261 | A | 9/1997 | Castren | |
| 6,038,902 | A | 3/2000 | Talley et al. | |
| 6,253,839 | B1 * | 7/2001 | Reagen et al. | 165/151 |
| 6,309,588 | B1 | 10/2001 | Powell et al. | |
| 6,370,775 | B1 * | 4/2002 | Reagen et al. | 29/890.047 |
| 6,715,202 | B2 | 4/2004 | Beaver | |
| 6,820,685 | B1 | 11/2004 | Carter et al. | |
| 6,928,833 | B2 | 8/2005 | Watanabe et al. | |

FOREIGN PATENT DOCUMENTS

| | | | |
|---|---|---|---|
| GB | 2146558 | A | 4/1985 |
| JP | 62013218 | A | 1/1987 |

* cited by examiner

*Primary Examiner* — Ljiljana Ciric
(74) *Attorney, Agent, or Firm* — Young & Thompson

(57) ABSTRACT

A tubular cooling element includes a continuous coil having a plurality of straight pipe sections and "U" shaped 180° elbow sections that are an integral part of the tubular cooling element, the continuous coil including a pipe having a wall thickness of from 0.270 inches to 0.600 inches and an outer diameter of from 2.375 inches to 3.5 inches.

4 Claims, 3 Drawing Sheets

WATER COOLED PANEL

BACKGROUND OF THE INVENTION

A. Field of the Invention

The present invention is related to water cooled panels for electric arc furnaces and more particularly to a water cooled panel having a tubular design comprised by a continuous coil formed by a thick wall pipe in which the 90° & 180° elbows are integral part of the pipe.

B. Description of the Related Invention

Temperatures higher than 2300° F. are generated inside electric arc furnaces. In order to avoid structural damages, water cooled panels are used in order to maintain the temperature of the structure below the failing point.

Typically, an electric arc furnace has several cooling systems. Normally, those systems comprise a cooling liquid recirculation circuit passing through all the elements of the furnace exposed to high temperatures. The water circulating inside the circuits passes through the elements that need to be cooled such as shell and roof panels, gas exhaust ducts, etc., in order to remove heat from those elements and subsequently transfer that heat to the environment using a cooling tower or an equivalent device.

The cooling circuit is typically comprised by several feeding pumps, return pumps, filters, one or more cooling towers as well as supervision and control instruments. The key elements of the furnace normally have instruments to monitor the flow, pressure and temperature of the water.

For most water cooled equipment, a flow interruption or an inadequate volume of water circulating through the cooling system may cause a serious thermal overload and sometimes a catastrophic failure.

Current electric arc furnaces have a variable quantity of water cooled panels mounted on a support frame, which allows for quick individual replacement of each panel. By cooling the furnace structure, thermal expansion and thermal stress are avoided which may cause gaps between panels. Water cooled panels allow the furnace to withstand high temperatures without suffering any structural damage. In old design electric arc furnaces, such high temperatures may have caused a higher erosion rate of the refractory walls and damages to the furnace shell.

Furthermore, cooling coils are used in the gas exhaust Ducts in order to cool said Ducts and avoid a structural damage and to cool down the gases to an adequate temperature for the filters to which the gases are conducted.

Typically the water cooled panels have a tubular design and comprise a hydraulic circuit requiring more than one pipe. In order to conduct the water from one pipe to the next one in the circuit, 90° & 180° elbows are used. This kind of hydraulic circuit is normally called "coil".

The use of said 180° elbows allows for a gap between the pipes that ranges from 0 to approximately a distance equivalent to the diameter of the pipe. Said 180° elbows are formed (cast, forged) independently of the pipes and are welded to the end of each pipe.

The process of welding an elbow to the ends of the pipes is costly, time consuming and creates a potential failure point.

Furthermore, the internal welded seams may cause additional pressure losses when the coil is in operation, reducing the efficiency of the entire cooling system.

In view of the above referred problems, the applicant developed a novel water cooled panel comprised by a continuous coil having an outer diameter of from 2.375 inches to 3.5 inches and a thickness of from 0.270 inches to 0.600 inches, which lacks welded 180° elbows since they are integrally formed with the pipe.

The water pressure losses obtained with the novel coil are equal or lower than the pressure losses obtained with the coils having welded elbows, thus optimizing the amount of electric energy used by the pumps which circulate the water through the cooling system.

SUMMARY OF THE INVENTION

It is therefore a main object of the present invention to provide a water cooled panel comprised by a continuous coil having an outer diameter of from 2.375 inches to 3.5 inches and a thickness of from 0.270 inches to 0.600 inches, lacking welded 180° elbows since the return sections are integral part of the pipe.

It is an additional object of the present invention to provide a water cooled panel comprised by a continuous coil in which the water pressure losses are equal or less than the pressure losses obtained with coils using welded elbows, thus optimizing the amount of electric energy used by the pumps which circulate the water through the cooling system.

These and other objects and advantages of the present invention will become apparent to those persons having an ordinary skill in the art, from the following detailed description of the embodiments of the invention, which will be made with reference to the accompanying drawings.

DETAILED DESCRIPTION OF THE INVENTION

Figure 1:
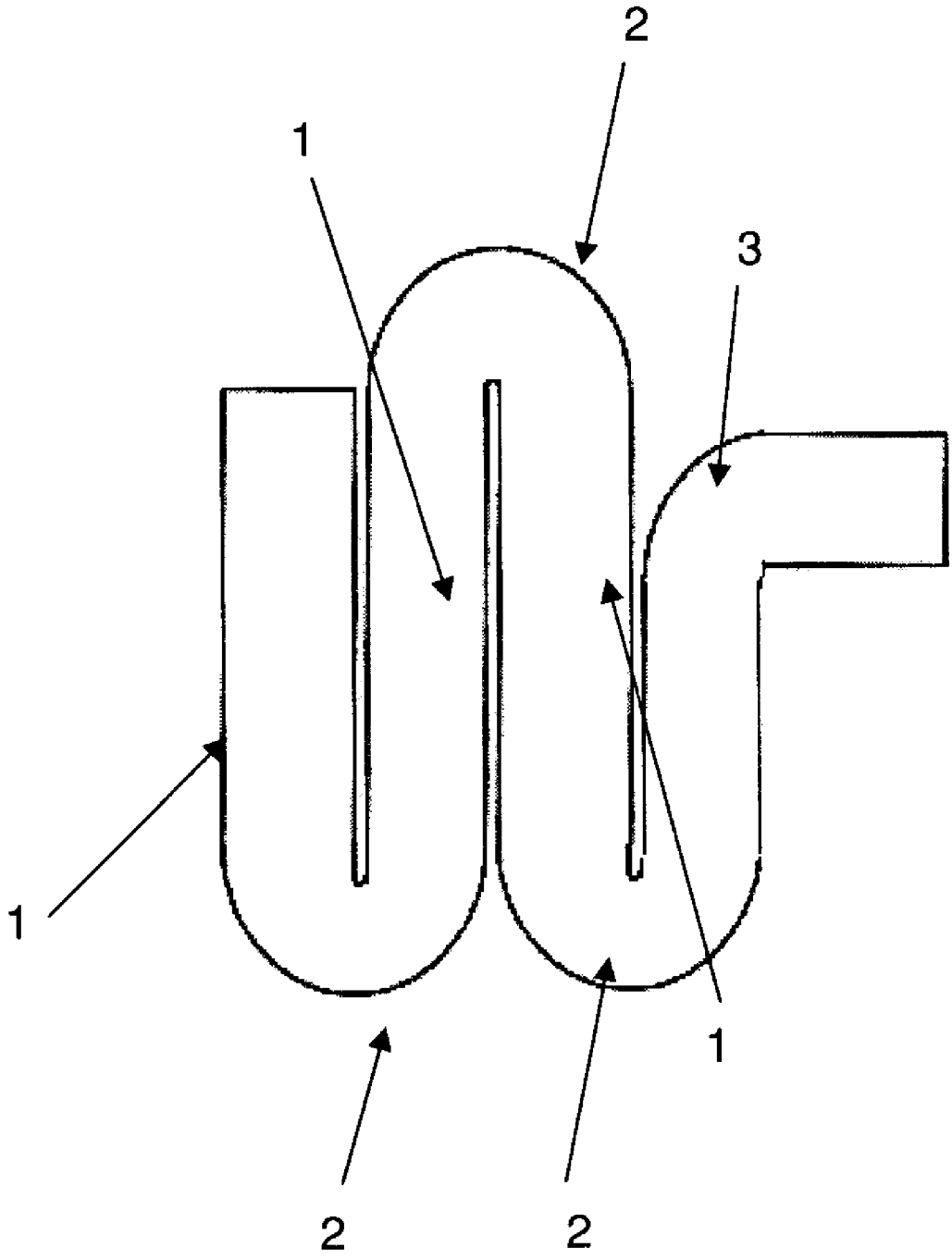
FIG. 1 is a front view of a section of the water cooled panel of the present invention.

The invention will now be described making reference to a preferred method for its manufacture and to specific examples of use by which the advantages of the water cooled panel comprised by a continuous coil of the present invention will be clearly appreciated when comparing the numeric values of pressure looses obtained versus a normal pipe.

The water cooled panel comprised by a continuous coil of the present invention may be manufactured by the method described in U.S. Pat. No. 7,121,131, wherein said process comprising the steps of:

Providing a pipe made of a metallic material selected form the group consisting of: carbon steel, copper and its alloys, stainless steel, low alloy steel, aluminum, etc. and of the type selected from the group consisting of: conventional or seamless, extruded, ribbed (splined), having a thickness of from 0.270 to 0.600;

defining a tangency point where a bend will occur;

pre-heating the pipe by means of the flame of an oxi-gas torch at the tangency point plus approximately 2" at a temperature of between 570° F. to 2200° F. for a time of between 30 seconds to 60 minutes and at a distance between the torch tip and the pipe that depends on the pipe material and thickness. An adequate pre-heating allows the material to yield when carrying out subsequent bending steps, minimizing deformations;

pre-bending the pipe 180° using as reference the tangency point as bending point in order to obtain a "U" shaped piece having two straight sections depending of a bent section, using conventional means which may comprise any bending tool, until a bending radius R/D of from 0.5 to 0.8 is obtained wherein R=bending radius and D=external pipe diameter;

heating the bent section in a special gas or induction furnace at a temperature of between 570° F. to 2200° F. and for a time of between 1 to 60 minutes depending on the pipe material and thickness;

immediately after removing the bent section from the furnace, introducing it to a special press having two lateral pressure elements, each applying a lateral pushing force along a straight section respectively for a distance of approximately 12" from the bent section, and a pressure element which applies a pushing force on the tangency point perpendicular to the lateral pushing forces, in order to provide to the "U" shaped piece the required final bending radius. As a result of this step, the cross sections of the straight and bent section acquire an oval shape;

applying a vertical compression force to the entire "U" shaped piece in order to round the straight and bent sections until the required roundness is obtained, by means of a press including a mold having the shape of the "U" shaped piece with the required roundness;

repeat the above described steps until forming all the required return sections of a coil.

If the pipe to be processed is made out of alloy steel, then a thermal treatment after the last step of the process is required. If the pipe to be processed is made of stainless steel, then a solution thermal treatment is necessary after the last step of the process.

It should be noted that the water cooled panel comprised by a continuous coil of the present invention may be manufactured by any other method capable of producing a radius of curvature R/D within a range of 0.5 to 0.8.

The water cooled panel of the present invention such as the one shown in FIG. 1, is comprised by a continuous coil having one or more straight pipe sections "1" and one or more "U" shaped elbow sections "2" bent at 180° that are integral part of the pipe, said tubular cooling element comprised by a metallic pipe having a wall thickness of from 0.270 inches to 0.600 inches and an outer diameter of from 2.375 inches to 3.5 inches, and wherein the radius of curvature R/D of the elbows bent at 180° is of from 0.5 to 0.8.

Furthermore, the water cooled panel of the present invention may include continuous 90° elbow sections "3".

The metallic pipe may be made of a metallic material selected form the group consisting of: carbon steel, copper and its alloys, stainless steel, low alloy steel, aluminum, etc. and of the type selected from the group consisting of: conventional or seamless, extruded, ribbed (splined).

The water cooled panel comprised by a continuous coil of the present invention has the advantage of achieving lower or equal pressure losses in comparison with the coils having welded 180° elbows as shown in the following examples:

EXAMPLE 1

Figure 2:
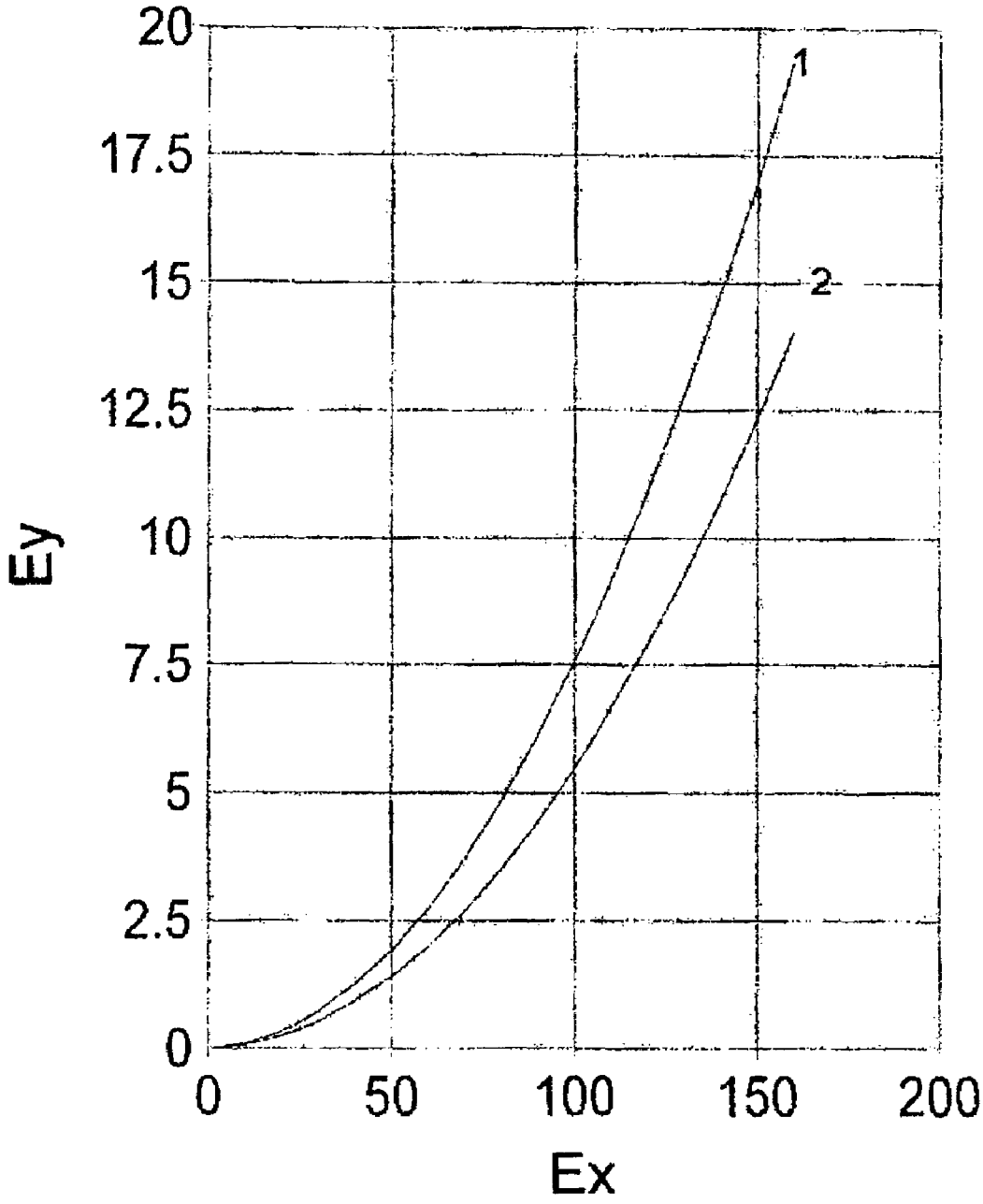
FIG. 2 is a graph showing the pressure losses of a coil fabricated with a metallic 2½" pipe having a thickness of 0.276 inches, having 180° welded elbows versus the pressure losses of a coil fabricated with 2½" pipe, having a thickness of 0.276 inches and lacking 180° welded elbows (continuous pipe) in accordance with the present invention.

A coil was formed having the following characteristics:
Pipe material: A106-Gr B
Pipe dimensions: 2½", width 0.276 in
Number of 180° elbow sections: 9
Pipe length (without 180° elbow sections): 32 ft.
Water cooled area: 8.7 $ft^2$ Results:
Radius of curvature: 0.5 (separation between straight sections 0.0 in)
Pressure losses: lower than the pressure losses of a coil having the same size but using welded elbows, as shown in Table 1 and the graph of FIG. 2, wherein: Ex shows the "X" axis representing a flow scale in gallons per minute (gpm); Ey shows the "Y" axis representing pressure losses scale in psi; 1 represents the pressure losses curve produced by a coil using welded elbows; and 2 represent the pressure losses curve obtained by the coil in accordance with the present invention.

TABLE 1

PRESSURE LOSSES COMPARISON CHART FOR PIPE COIL HAVING A WIDTH OF 0.276 INCHES USING WELDED 180° ELBOWS VS COIL FORMED BY THE PROCESS OF THE PRESENT INVENTION

| FLOW (GPM) | PRESSURE LOSSES (PSI) BENT PIPE | WITH WELDED 180° ELBOWS | DIFERENCE % |
|---|---|---|---|
| 0 | 0 | 0 | 0.0000 |
| 10 | 0.06001624 | 0.08084368 | 25.7626 |
| 20 | 0.23162623 | 0.31493599 | 26.4529 |
| 30 | 0.51099019 | 0.69843715 | 26.8381 |
| 40 | 0.89629347 | 1.22953250 | 27.1029 |
| 50 | 1.38634242 | 1.90702840 | 27.3035 |
| 60 | 1.98025490 | 2.73004272 | 27.4643 |
| 70 | 2.68185495 | 3.70239948 | 27.5644 |
| 80 | 3.50283095 | 4.83578707 | 27.5644 |
| 90 | 4.43327043 | 6.12029301 | 27.5644 |
| 100 | 5.47317337 | 7.55591730 | 27.5644 |
| 110 | 6.62253977 | 9.14265994 | 27.5644 |
| 120 | 7.88136965 | 10.88052090 | 27.5644 |
| 130 | 9.24966299 | 12.76950020 | 27.5644 |
| 140 | 10.72741980 | 14.80959790 | 27.5644 |
| 150 | 12.31464010 | 17.00081390 | 27.5644 |
| 160 | 14.01132380 | 19.34314830 | 27.5644 |

EXAMPLE 2

Figure 3:
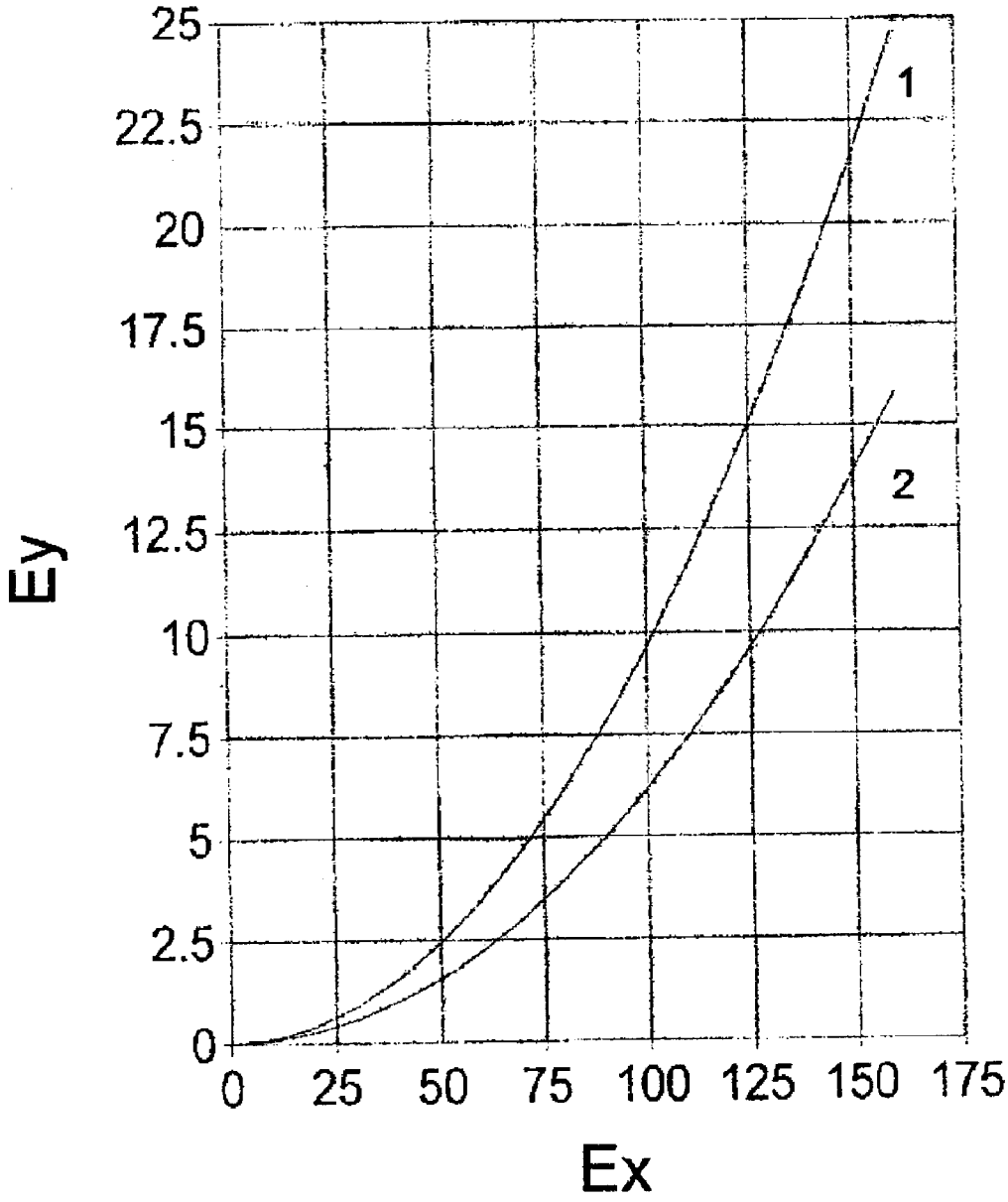
FIG. 3 is a graph showing the pressure losses of a coil fabricated with a metallic 2½" pipe having a thickness of 0.344 inches, having 180° welded elbows versus the pressure losses of a coil formed with 2½" pipe having a thickness of 0.344 inches and lacking 180° welded elbows (continuous pipe) in accordance with the present invention.

A coil was formed having the following characteristics:
Pipe material: A106-Gr B
Pipe dimensions: 2½", width 0.344 in
Number of 180° elbow sections: 9
Pipe length (without 180° elbow sections): 32 ft.
Water cooled area: 8.7 $ft^2$ Results:
Radius of curvature: 0.5 (separation between straight sections 0.0 in)
Pressure losses: lower than the pressure losses of a coil with the same size but using welded 180° elbows, as shown in Table 2 and FIG. 3 graph, wherein: Ex shows the "X" axis representing a flow scale in gallons per minute (gpm); Ey shows the "Y" axis representing a pressure loss scale in psi; 1 represents the pressure loss curve produced by a coil using welded 180° elbows; and 2 represents the pressure loss curve obtained by the coil of the present invention.

TABLE 2

PRESSURE LOSSES COMPARISON FOR COIL HAVING A WIDTH OF 0.344 INCHES USING WELDED 180° ELBOWS VS COIL FORMED BY THE PROCESS OF THE PRESENT INVENTION

| FLOW (GPM) | PRESSURE LOSS (PSI) BENT PIPE | PRESSURE LOSS (PSI) WITH WELDED 180° ELBOWS | DIFFERENCE % |
|---|---|---|---|
| 0 | 0 | 0 | 0.0000 |
| 10 | 0.06991225 | 0.10453932 | 33.1235 |
| 20 | 0.26587133 | 0.40437959 | 34.2520 |
| 30 | 0.58160812 | 0.89325170 | 34.8887 |
| 40 | 1.01415987 | 1.56819290 | 35.3294 |
| 50 | 1.56157775 | 2.42725436 | 35.6648 |
| 60 | 2.21866089 | 3.46523521 | 35.9737 |
| 70 | 3.01984399 | 4.71657015 | 35.9737 |
| 80 | 3.94428603 | 6.16041816 | 35.9737 |
| 90 | 4.99198701 | 7.79677923 | 35.9737 |
| 100 | 6.16294692 | 9.62565337 | 35.9737 |
| 110 | 7.45716578 | 11.64704060 | 35.9737 |
| 120 | 8.87464357 | 13.86094090 | 35.9737 |
| 130 | 10.41538030 | 16.26735420 | 35.9737 |
| 140 | 12.07937600 | 18.86628060 | 35.9737 |
| 150 | 13.86663060 | 21.65772010 | 35.9737 |
| 160 | 15.77714410 | 24.64167260 | 35.9737 |

What is claimed is:

1. A tubular cooling element comprising a continuous coil having one or more straight pipe sections and one or more "U" shaped elbow sections bent at 180° that are an integral part of the tubular cooling element, said tubular cooling element comprising a metallic pipe having a wall thickness of from 0.270 inches to 0.600 inches and an outer diameter of from 2.375 inches to 3.5 inches, wherein the radius of curvature R/D of the one or more "U" shaped elbow sections bent at 180° is of from 0.5 to 0.8.

2. The tubular cooling element as claimed in claim 1, further including continuous sections bent at 90°.

3. The tubular cooling element as claimed in claim 1 wherein the metallic pipe is made of a material selected from the group consisting of carbon steel, copper, stainless steel, low alloy steel and aluminum.

4. The tubular cooling element as claimed in claim 1 wherein the metallic pipe is made of a material selected from the group consisting of carbon steel, copper and its alloys, stainless steel, low alloy steel and aluminum and is of the type selected from the group consisting of: conventional or seamless, extruded, and ribbed.

* * * * *